US009567151B2

(12) United States Patent
Su

(10) Patent No.: US 9,567,151 B2
(45) Date of Patent: Feb. 14, 2017

(54) STORAGE CONTAINER WITH INSULATION EFFECT

(71) Applicant: Yu-Hsin Su, New Taipei (TW)

(72) Inventor: Yu-Hsin Su, New Taipei (TW)

( * ) Notice: Subject to any disclaimer, the term of this patent is extended or adjusted under 35 U.S.C. 154(b) by 102 days.

(21) Appl. No.: 14/556,254

(22) Filed: Dec. 1, 2014

(65) Prior Publication Data

US 2016/0152402 A1 Jun. 2, 2016

(51) Int. Cl.
*B65D 81/38* (2006.01)
*B65D 57/00* (2006.01)

(52) U.S. Cl.
CPC ..... *B65D 81/3895* (2013.01); *B65D 57/00* (2013.01); *B65D 81/382* (2013.01); *B65D 81/3823* (2013.01); *B65D 81/3897* (2013.01); *B65D 2313/02* (2013.01)

(58) Field of Classification Search
CPC ..... B65D 81/3895; B65D 81/3893; B65D 81/3897; B65D 81/3834; B65D 81/3825; B65D 81/3816; B65D 81/382; B65D 81/3813; B65D 81/38; B65D 81/18; B65D 81/052
USPC ..... 220/592.01, 592.02, 592.03, 592.05,220/592.09, 592.15, 592.1, 592.24–28, 9.4; 383/39, 44
See application file for complete search history.

(56) References Cited

U.S. PATENT DOCUMENTS 4,172,152 A * 10/1979 Carlisle ..... B65D 81/3893 220/560.03
5,535,888 A * 7/1996 De Luca ..... B65D 81/3893 206/521
6,244,458 B1 * 6/2001 Frysinger ..... B65D 81/3823 220/592.09
6,276,548 B1 * 8/2001 Mitchell ..... D06F 95/002 220/6
8,100,280 B1 * 1/2012 Hernandez ..... D06F 95/002 206/278
2011/0215095 A1 * 9/2011 Lin ..... B65D 25/00 220/9.4

* cited by examiner

*Primary Examiner* — Anthony Stashick
*Assistant Examiner* — Robert Poon

(57) ABSTRACT

The present invention provides a storage container with insulation effect, for long-term storage of fresh foods and drinks, said container having a storage space, characterized in that: the storage space includes a supporting frame with a positioning space formed therein and an insulation device provided inside the positioning space; said supporting frame comprising a plurality of longitudinal poles, transverse poles, vertical poles, and branch joints for forming the positioning space; said insulation device comprising at least one sheet-shaped bag and one positioning unit arranged corresponding to the sheet-shaped bag, the sheet-shaped bag configured to hold liquid, the positioning unit configured to fix the sheet-shaped bag on a corresponding side face of the positioning space to avoid movement; the sheet-shaped bag having a flow passage disposed therein for holding the liquid, and flow passages having a one-way valve arranged at one end thereof, which can be used with an injection device for control of the liquid input.

6 Claims, 12 Drawing Sheets

STORAGE CONTAINER WITH INSULATION EFFECT

BACKGROUND OF INVENTION

1. Field of the Invention

The present invention relates to a storage container with fresh-keeping and insulation effect.

2. Description of Related Art

The conventional cooler/warmer bags or cases used during trips are mostly used to preserve the freshness of foods or drinks, such as luggage bag with heat preservation effect, or ice bags or cases for fishing. The insulation structure includes heat insulation foam or polyfoam to preserve heat. However, when used to keep cold food or drink, as there is no design inside the bag (case) to actively or passively maintain the temperature, the cooling effect is limited and cannot be used for long-term storage.

Although crushed ice or chemical ice packs can be placed inside the cooler bags (cases) to keep the temperature low, or hot water bags can be used to keep the temperature high, those can only be placed on the bottom of the bag (case), and cannot be placed around the objects. Hence, although the bottom of the bags (cases) is kept cold or warm, the temperature stability is poor, and heat exchange with the outside environment results in low fresh-keeping effect.

In view of this, the present invention intends to solve the above shortcomings and provide a storage container with fresh-keeping, insulation, and waterproof effect, without using chemical cooling fluids.

SUMMARY OF THE INVENTION

First: the present invention provides a supporting frame and an insulation device. The storage container can use a supporting frame to support the insulation device for use, or be used without the supporting frame as a backpack, a warmer bag, a luggage bag, or a storage case. When removed, the supporting frame can be disassembled, and the insulation device can be folded after discharging the liquid, so as to save storage space.

Second: the sheet-shaped bags inside the insulation device can control the flow of liquid through a one-way valve. For cooling, the user can place the sheet-shaped bags in a freezing chamber so that the liquid becomes icy, and then used in the storage container to keep coldness and freshness. When the ice melts into water, the liquid is still kept inside the sheet-shaped bag, and the bag can be placed inside the freezing chamber again for icing. In this way, the ice bags can be used repeatedly, making the present invention economical, convenient and environmentally-friendly.

Third: the positioning space was configured to fix the sheet-shaped bag by the supporting frame, thus tightly contacting the casing of the storage container for waterproof effect. Hence, the storage container can offer fully insulation effect on the bottom, as well as all four sides, thus prolonging the fresh-keeping and insulation effect.

Fourth: the sheet-shaped bag can be hung on the supporting frame, and use the waterproof bag for replacement or repeated use; when the liquid inside the sheet-shaped bag changes from a frozen state to a liquid state, the water drops formed on the surface due to heat absorption and condensation can be collected into the waterproof bags, avoiding the water flowing into the storage container and the water accumulation problem.

Fifth: the one-way valve can avoid reverse flow when filling the liquid, thereby reducing the difficulty of injecting liquid. The valve plate and torsion spring can automatically and quickly seal the water inlet by the elastic energy of the torsion spring. After filling the liquid into the sheet-shaped bag, a pressure is generated against the valve plate for better sealing effect. Moreover, a plastic cap on the water inlet can form a second sealing to prevent leakage.

DETAILED DESCRIPTION OF THE INVENTION

Figure 1:
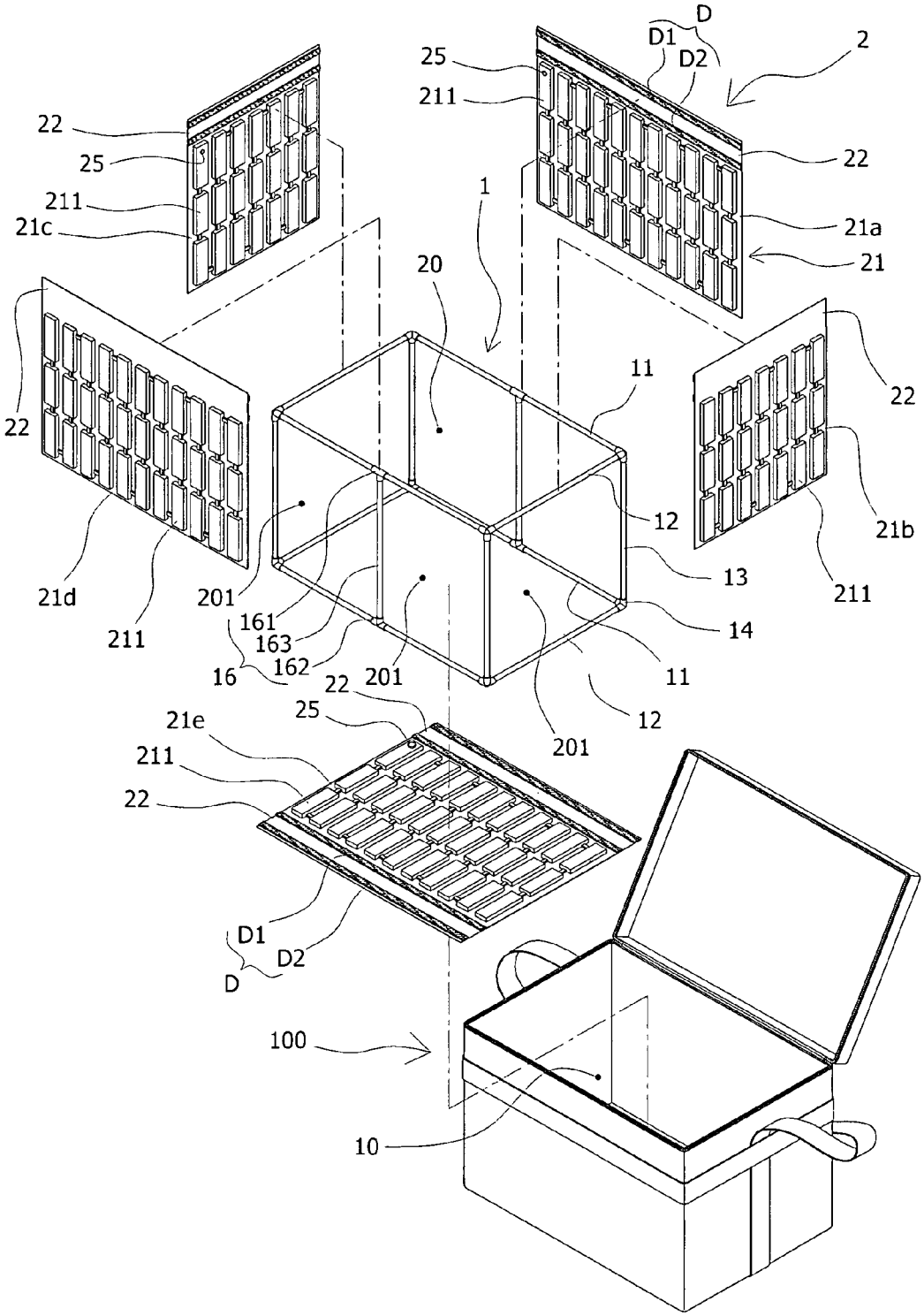
FIG. 1: Perspective exploded view of the first embodiment of the present invention.

The first embodiment of the present invention is disclosed in FIGS. 1 to 5. As disclosed in the drawing, a container (100) having a storage space (10), characterized in that the storage space (10) includes a supporting frame (1) with a positioning space (20) formed therein and a insulation device (2) provided inside the positioning space (20); said supporting frame (1) comprising a plurality of longitudinal poles (11), transverse poles (12), vertical poles (13) and branch joints (14) for forming the positioning space (20), the transverse poles (12) perpendicularly arranged between the corresponding ends of the longitudinal poles (11), the vertical poles (13) arranged perpendicularly to the longitudinal poles (11) and the transverse poles (12), the branch joints (14) disposed at each corner of the supporting frame (1) and respectively connected with the longitudinal poles (11), the transverse poles (12), and the vertical poles (13); said insulation device (2) comprising at least one sheet-shaped bag (21) (the drawing discloses 5, respectively being 21*a*, 21*b*, 21*c*, 21*d*, 21*e*), and a positioning unit (22) arranged corresponding to the sheet-shaped bag (21), the sheet-shaped bag (21) configured to hold liquid, the positioning unit (22) configured to fix the sheet-shaped bag (21) on a corresponding side face (201) of the positioning space (20) to avoid movement; the sheet-shaped bag (21) having a flow passages (211) disposed therein for holding the liquid, and the flow passage (211) having a one-way valve (23) arranged at one end thereof, which can be used with an injection device (200) for control of the liquid input; said positioning unit (22) comprising a plate body part (221) adjoined at least one side of the sheet-shaped bag (21) of the longitudinal pole (11) and/or the transverse pole (12), and a Velcro D for the plate body part (221) wrapping the longitudinal pole (11) and/or the transverse pole (12) so as to hang and fix the sheet-shaped bag (21).

Based on the above, the supporting frame (1) comprises a plurality of longitudinal poles (11), transverse poles (12), vertical poles (13), and branch joints (14) for supporting the insulation device (2), provided inside the positioning space (20). Further, the insulation device (2) comprises at least one sheet-shaped bag (21), so that the storage space (10) can have insulation effect. Through temperature change of the liquid injected inside the sheet-shaped bag (21), the device provides fresh-keeping and insulation effect.

Secondly, the liquid inside the sheet-shaped bag (21) can be clean water, salt water or refrigerant, among which clean water is easiest to use because water has a higher specific heat capacity than other substances. Hence, at the same change of temperature, water can absorb and release more heat. In other words, water needs more heat to generate a temperature change of 1° C., thus it has a better heat preservation effect than other substances. Fresh food can thus be placed inside the storage space (10) to be kept cool and fresh for a long time in the sheet-shaped bag (21).

Furthermore, when the storage container (100) is not in use and the user wants to store the sheet-shaped bag (21), the liquid inside the sheet-shaped bag (21) can be discharged through the one-way valve (23), so that the bags can be folded and stored for future use. To use, the user can simply inject liquid and the bag is ready to use. Therefore, the present invention is environmentally-friendly, economical and practical.

Moreover, apart from the embodiment disclosed in FIG. 1, the sheet-shaped bag (21) can be placed on top of the storage container (100) [not disclosed in the drawings], so that all the six internal sides of the storage container (100) have a long-lasting insulation effect.

Figure 6:
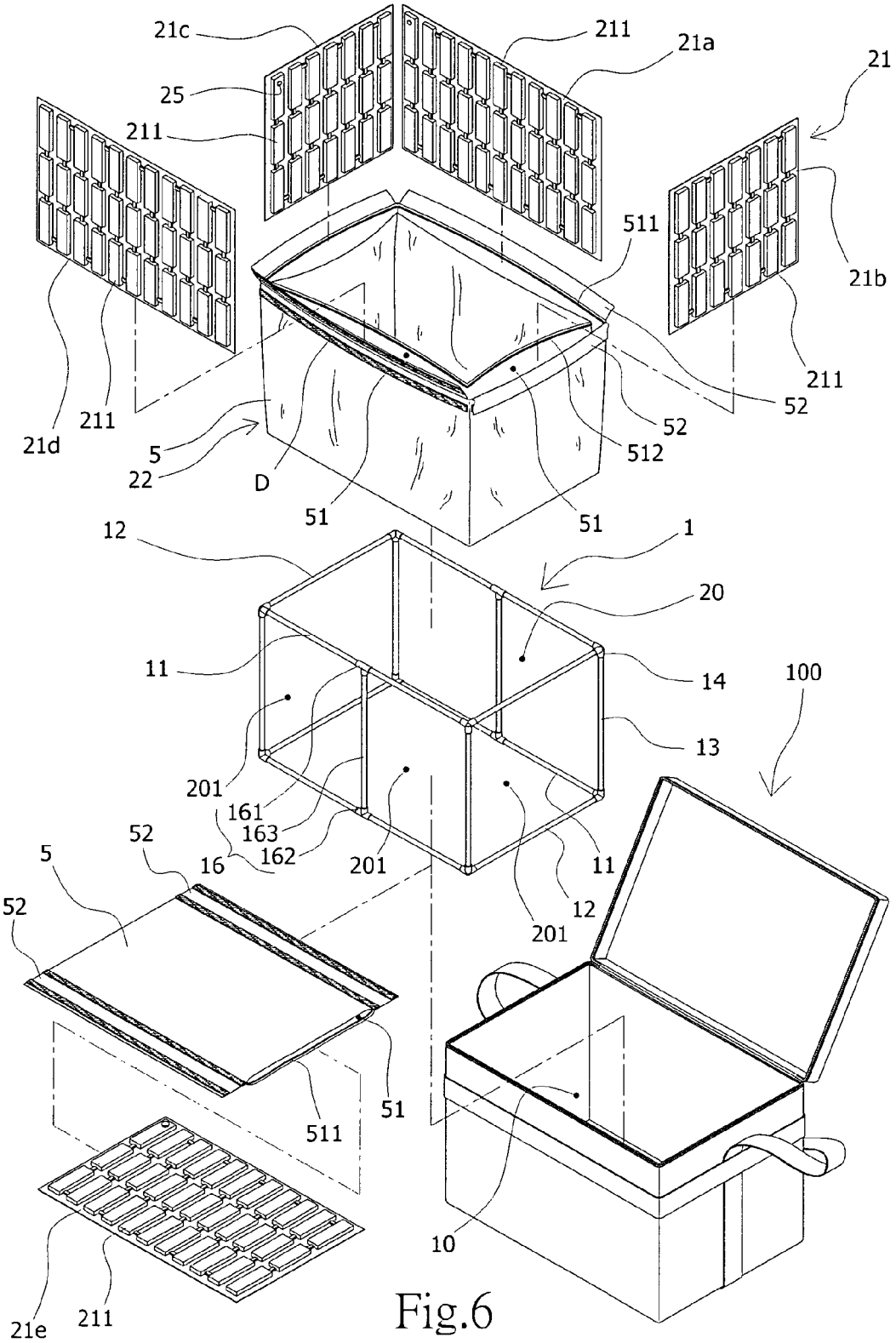
FIG. 6: Perspective exploded view of a second embodiment of the present invention.
Figure 7:
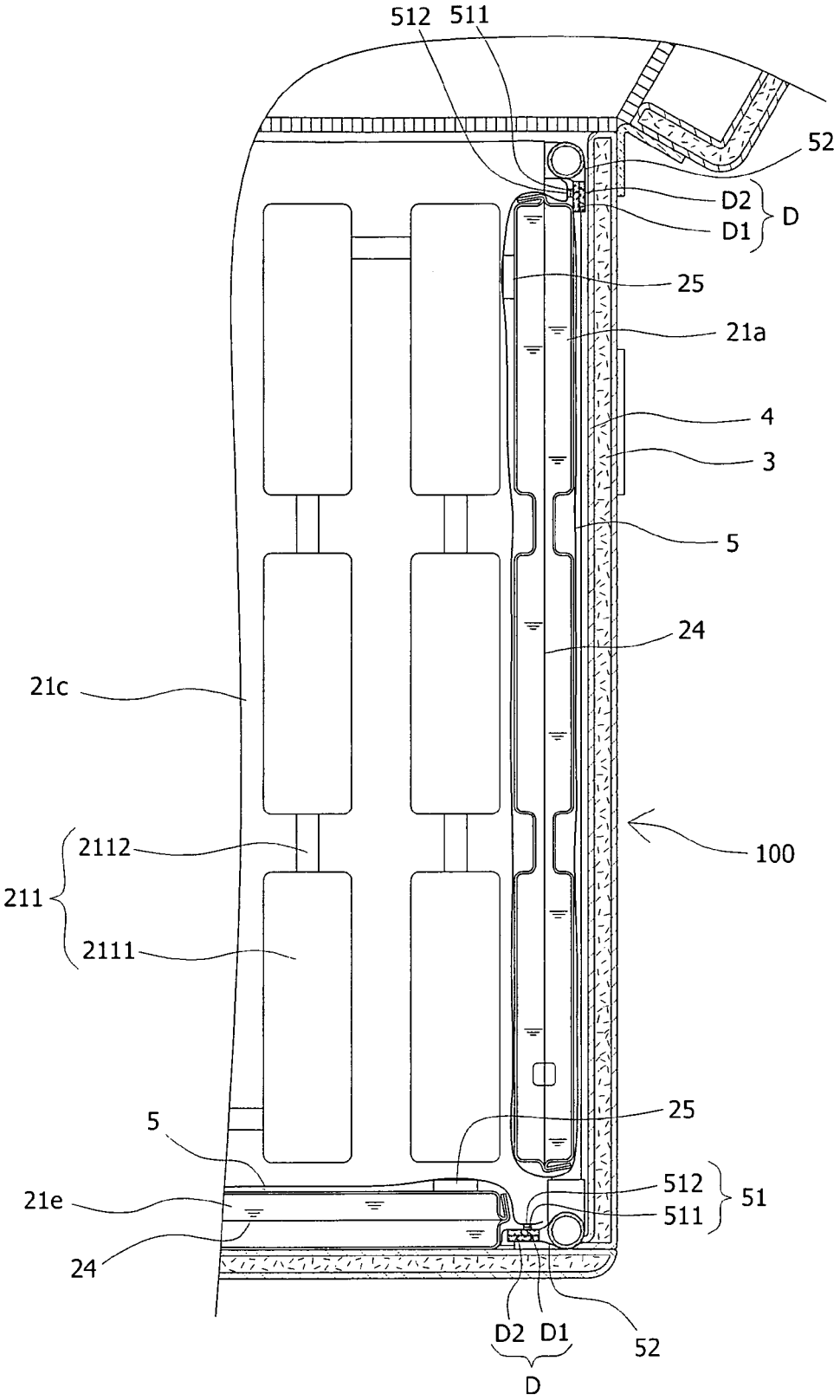
FIG. 7: Partial sectional view of the embodiment disclosed in FIG. 6 after assembly.

FIGS. 6 and 7 disclose a second embodiment of the present invention. A storage container (100), said container (100) having a storage space (10), characterized in that: the storage space (10) include a supporting frame (1) with a positioning space (20) formed therein and an insulation device (2) provided inside the positioning space (20); said supporting frame (1) comprising a plurality of longitudinal poles (11), transverse poles (12), vertical poles (13), and branch joints (14) for forming the positioning space (20), the transverse poles (12) perpendicularly arranged between the corresponding ends of the longitudinal poles (11), the vertical poles (13) arranged perpendicularly to the longitudinal poles (11) and the transverse poles (12), the branch joints (14) disposed at each corner of the supporting frame (1), and respectively connected with the longitudinal poles (11), the transverse poles (12), and the vertical poles (13); said insulation device (2) comprising at least one sheet-shaped bag (21) (the drawing discloses 5, respectively being 21*a*, 21*b*, 21*c*, 21*d*, 21*e*), and a positioning unit (22) arranged corresponding to the sheet-shaped bag (21), the sheet-shaped bag (21) configured to hold liquid, the positioning unit (22) configured to fix the sheet-shaped bag (21) on a corresponding side face (201) of the positioning space (20) to avoid movement; the sheet-shaped bag (21) having a flow passages (211) disposed therein for holding the liquid, and the flow passage (211) having a one-way valve (23) arranged at one end thereof, which can be used with an injection device (200) for control of the liquid input; said positioning unit (22) comprising a plurality of waterproof bags (5) to hold the sheet-shaped bag (21) and fix the sheet-shaped bag (21) on a corresponding side face (201) of the positioning space (20) to avoid movement and to provide a waterproof function, the waterproof bags (5) having an opening (51) disposed on one side end thereof, and the opening (51) having a covering plate (52) and a Velcro (D) arranged between one side of the opening (51) and a corresponding side of the covering plate (52), the Velcro (D) wrapping the longitudinal pole (11) and/or the transverse pole (12) to hang and fix the sheet-shaped bag (21).

The advantages of the second embodiment are similar to the first embodiment. The difference lies in the positioning unit (22), which facilitates easy replacement of the sheet-shaped bag (21) at any time with the waterproof bags (5), said waterproof bag (5) having an opening (51) arranged at one end thereof to put in the sheet-shaped bag (21), the covering plate (52) and the Velcro (D) can affix the waterproof bag (5) inside the positioning space (20). When the ice inside the sheet-shaped bag (21) absorbs heat to cause gradual phase changes, and converts into icy water, the sheet-shaped bag (21) remains waterproof, so that it can be used repeatedly. When the surface of the sheet-shaped bag (21) contacts with the outside hot air, there will be condensation of water drops, which are collected inside the waterproof bag 5, without flowing into the storage container (100), thus, water accumulation inside the storage container (100) does not leak.

In the above design, the opening (51) having a sealing bar (511) disposed in one side end thereof, and a sealing slot (512) disposed in another side end thereof to communicate with the sealing bar (511). The sealing bar (511) and sealing slot (512) together can allow the user to quickly seal the opening (51) after putting in the sheet-shaped bag (21), thus effectively avoid water leakage and ensure convenient use.

In the two preferred embodiments, said Velcro (D) comprises a Velcro hooks unit (D1), and a Velcro loops unit (D2), which enable the plate body part (221) and covering plate (52) wrapping the longitudinal pole (11) and/or transverse pole (12) to hang and fix the sheet-shaped bag (21) for easy use. The Velcro hooks unit (D1) and Velcro loops unit (D2) configured as in the first embodiment disclosed in FIG. 1, wherein the plate body part (221) having the Velcro hooks unit (D1) disposed on one end side thereof, and the Velcro loops unit (D2) disposed on the other end side thereof, or reversely disposed. The configuration can be modified according to application, and is not limited to the one disclosed in FIG. 1. Alternatively, as in the second embodiment disclosed in FIG. 6, the covering plate (52) having the Velcro hooks unit (D1) disposed on one end side thereof, and the Velcro loops unit (D2) disposed on the corresponding end side of the outside of the opening (51), or reversely disposed. The configuration can be modified according to application and is not limited to the one disclosed in FIG. 6.

In the two preferred embodiments, the longitudinal pole (11) and transverse pole (12) further include a spring (15) arranged inside a connection part whereat the branch joints (14) are disposed, said spring (15) configured to have an outward push force. When the storage container (100) is a soft storage container, the spring (15) can push the storage container (100) outward, so that the storage container (100) is firm the storage container (100) held to be stable by the supporting frame (1) therein.

In the two preferred embodiments, the longitudinal pole (11) further includes a central supporting component (16) arranged therebetween to connect simultaneously with both sides of the longitudinal poles (11) when there is more than one longitudinal pole (11), the central supporting component (16) including a top T-shape branch joint (161) disposed between and connected the longitudinal poles (11) on the two top sides, a bottom T-shape branch joint (162) disposed between and connected the longitudinal poles (11) on the two bottom sides, and a central vertical pole (163) vertically disposed between the top T-shape branch joint (161) and the bottom T-shape branch joint (162); a connection part between said top T-shape branch joint (161) and bottom T-shape branch joint (162) further provided with a spring (15) generating an outward push force at the positions connecting with the longitudinal poles (11).

The central supporting component (16), including a top T-shape branch joint (161), bottom T-shape branch joint (162), and central vertical pole (163), can solve the problem of insufficient support to the sheet-shaped bag (21) when the longitudinal poles (11) are too long, and can provide a solid support to the sheet-shaped bag (21).

Said spring (15) enables the longitudinal poles (11) connected by the top T-shape branch joint (161) and bottom T-shape branch joint (162) to generate a similar outward push force, so that the supporting frame (16) can be stably positioned inside the storage container (100).

Figure 2:
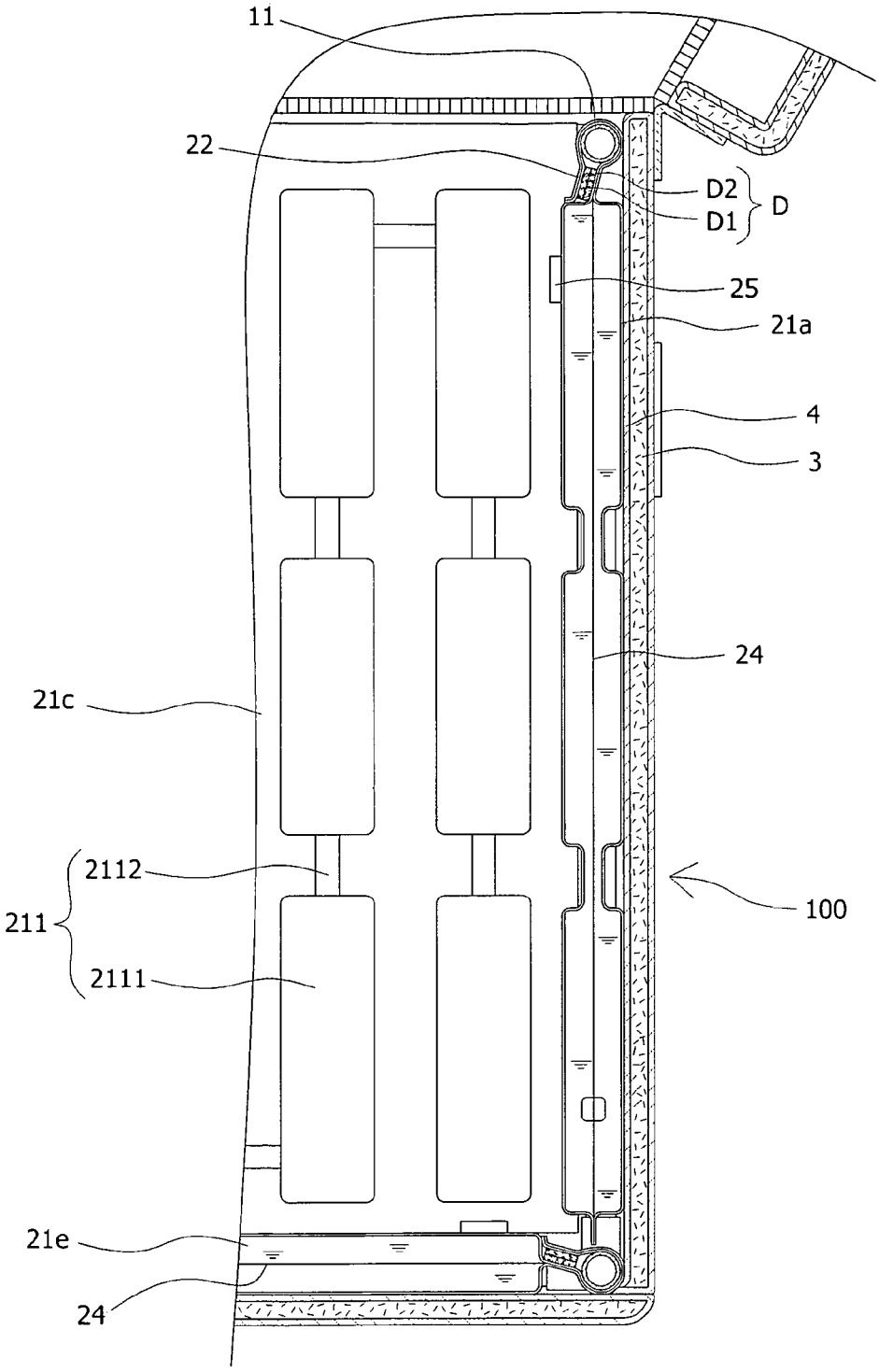
FIG. 2: Partial sectional view of the embodiment disclosed in FIG. 1 after assembly.
Figure 3:
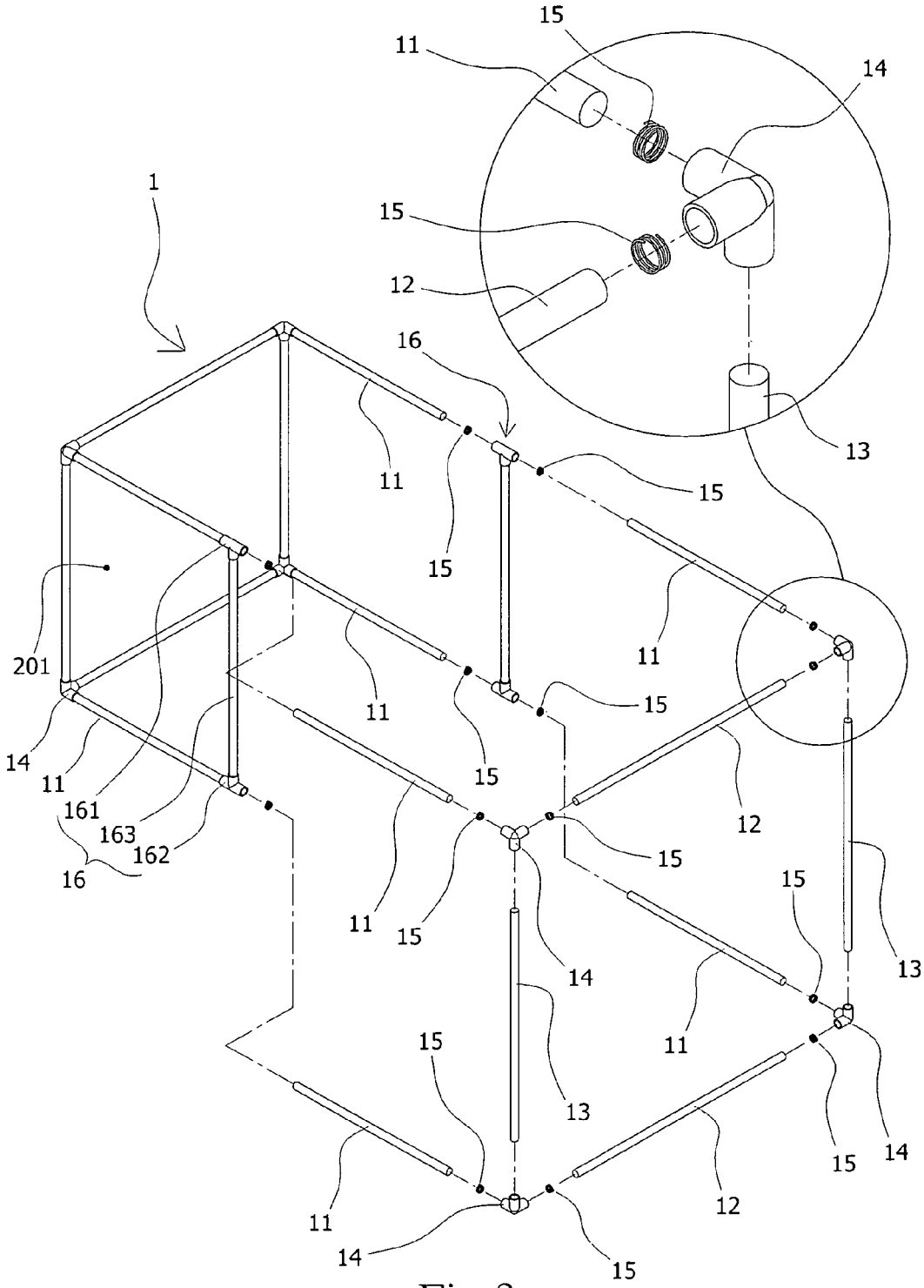
FIG. 3: Perspective exploded view of the supporting frame disclosed in FIG. 1.
Figure 4:
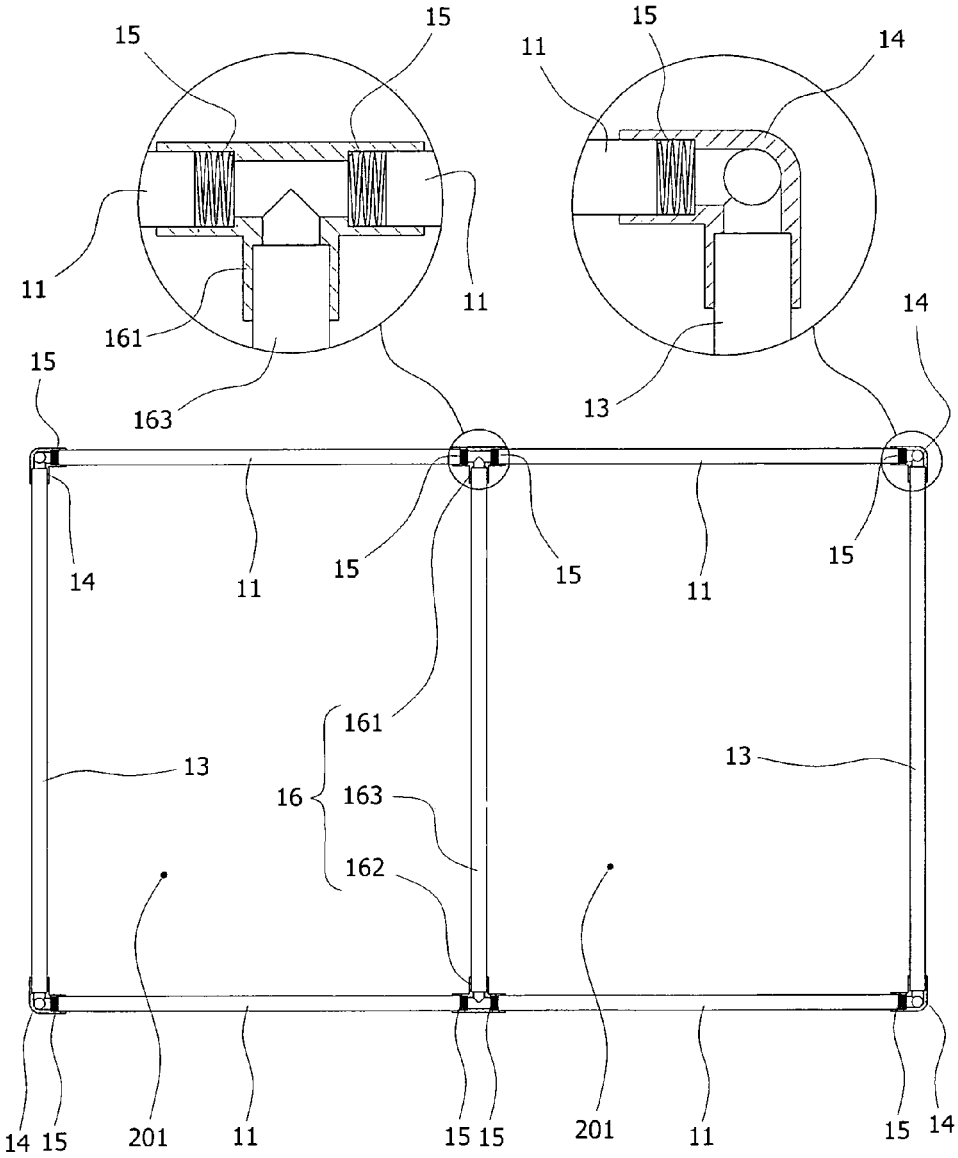
FIG. 4: Top view of the supporting frame disclosed in FIG. 1 and sectional view of branch joints.
Figure 5:
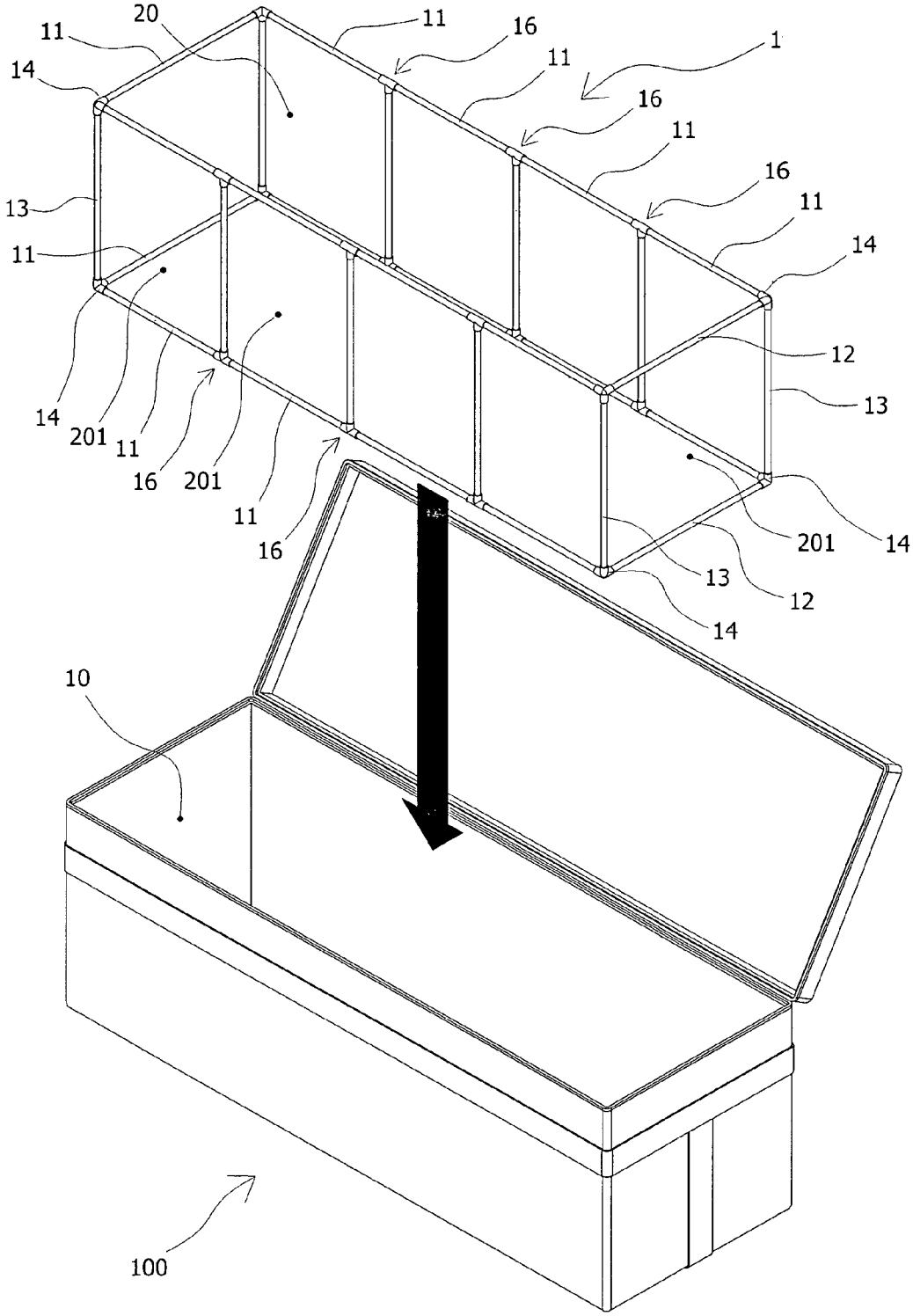
FIG. 5: Implementation view of another kind of supporting frame in the embodiment disclosed in FIG. 1 corresponding to a storage container.

Referring to FIGS. 2 and 7, said sheet-shaped bag (21) is made by laminating two Nylon and LLDPE plastic films with good toughness and resistance to high and low temperatures, the sheet-shaped bag (21) further includes a plurality of heat sealing lines 24 distributed at regular intervals, so as to form flow passages (211) inside for liquid flow. The Nylon and LLDPE plastic film is made of composite material and is a high-density plastic cloth to ensure good strength of the sheet-shaped bag (21) for long-term usage without leakage.

Secondly, when the flow passages (211) are filled with liquid, the heat sealing lines (24) distributed at regular intervals formed multiple bars of water bags, so that the sheet-shaped bag (21) can easily curve in applications to be adjusted to match the supporting frame (16), and be used in a storage container (100) of any shape.

Referring to FIGS. 8 to 12, said one-way valve (23) comprises a positioning plate (231) arranged inside one end of the flow passage (211); a water inlet (232) arranged inside the positioning plate (231) with internal threads on its inner wall; a convex ring portion (233) arranged at a bottom surface of the positioning plate (231), corresponding to the water inlet (232), and communicated with the water inlet (232); an anti-leakage ring (234) arranged at a bottom end of the convex ring portion (233); a valve plate (235) pivotally arranged on the bottom surface of the positioning plate (231) for sealing the convex ring portion (233) to control water inlet; and at least one torsion spring (236) arranged at a pivot of the valve plate (235), to force the valve plate (235) to tightly seal the convex ring portion (233); the valve plate (235) including a valve cover gasket (2351) disposed in one side thereof for sealing the convex ring portion (233), and a pivot portion (2352) disposed in another side thereof for configuring the torsion spring (236); moreover, the positioning plate (231) including a pivot positioning seat (2311) corresponding to the pivot portion (2352) for pivot connection; said one-way valve (23) further including a rubber cap (25) to seal the water inlet (232).

In particular, said one-way valve (23) differs from the conventional one-way valve in that, the valve plate (235) and the torsion spring (236) jointly enable automatic and instant sealing of the water inlet (232) through the elastic energy of the torsion spring (236). Moreover, when there is liquid inside the flow passage (211), the valve plate (235) disposed inside the flow passage (211) can push the liquid against the valve cover gasket (2351), thereby forcing the valve cover gasket (2351) to contact tightly with the convex ring portion (233). This mechanism, along with the pressure from the torsion spring (236), ensures the container to be waterproof.

Secondly, the water inlet (232) connected to the liquid injection device (200), and the anti-leakage ring (234) prevented the liquid from leaking out from the gap between the convex ring portion (233) and the valve cover gasket (2351), ensuring the sealing effect of the one-way valve (23).

Furthermore, the rubber cap (25) formed a second seal to enhance sealing and avoid leakage.

Figure 8:
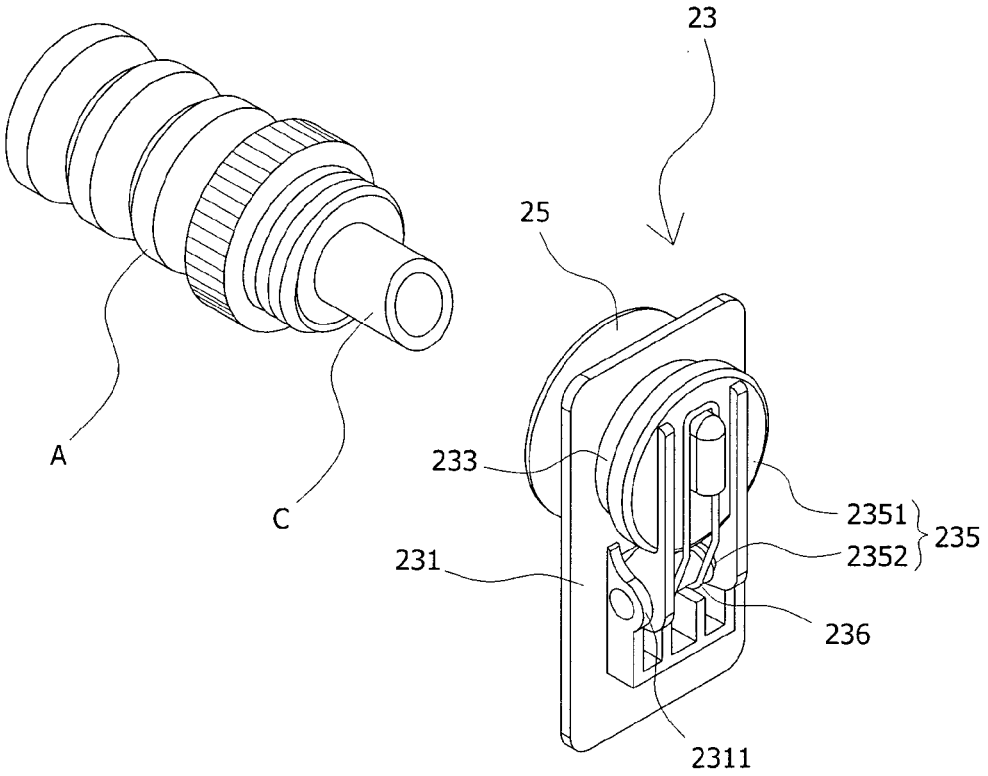
FIG. 8: Perspective view of the one-way valve and liquid injection device disclosed in the present invention.
Figure 9:
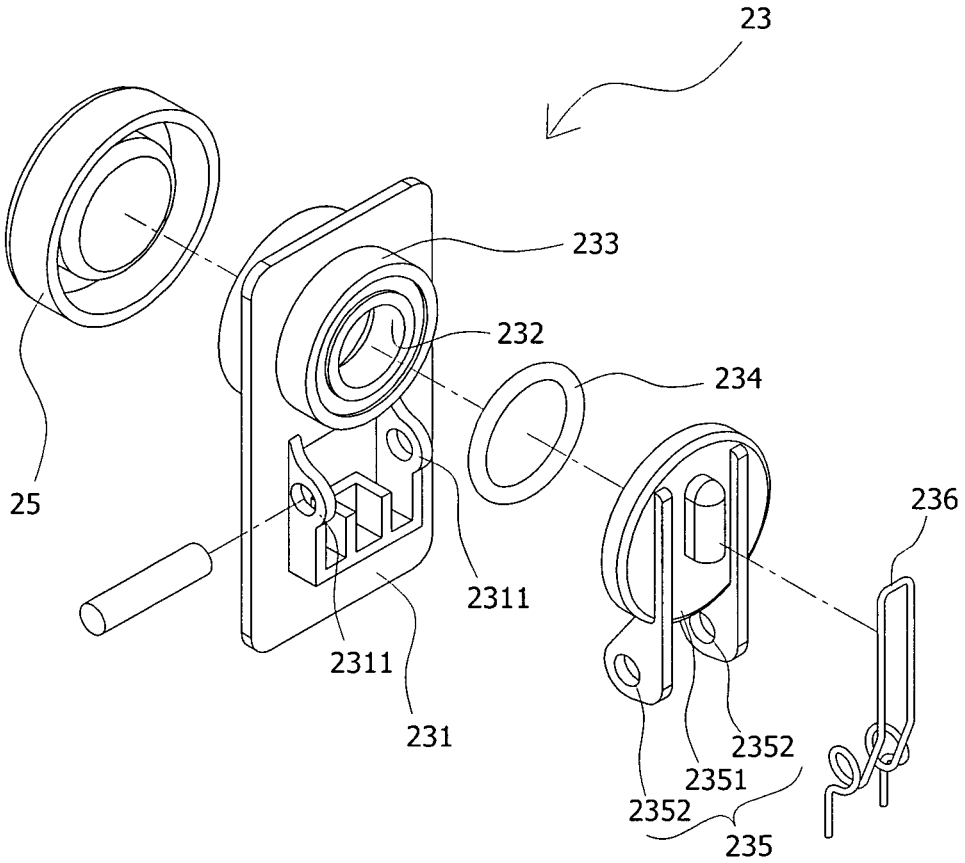
FIG. 9: Perspective exploded view of the one-way valve disclosed in FIG. 8.
Figure 10:
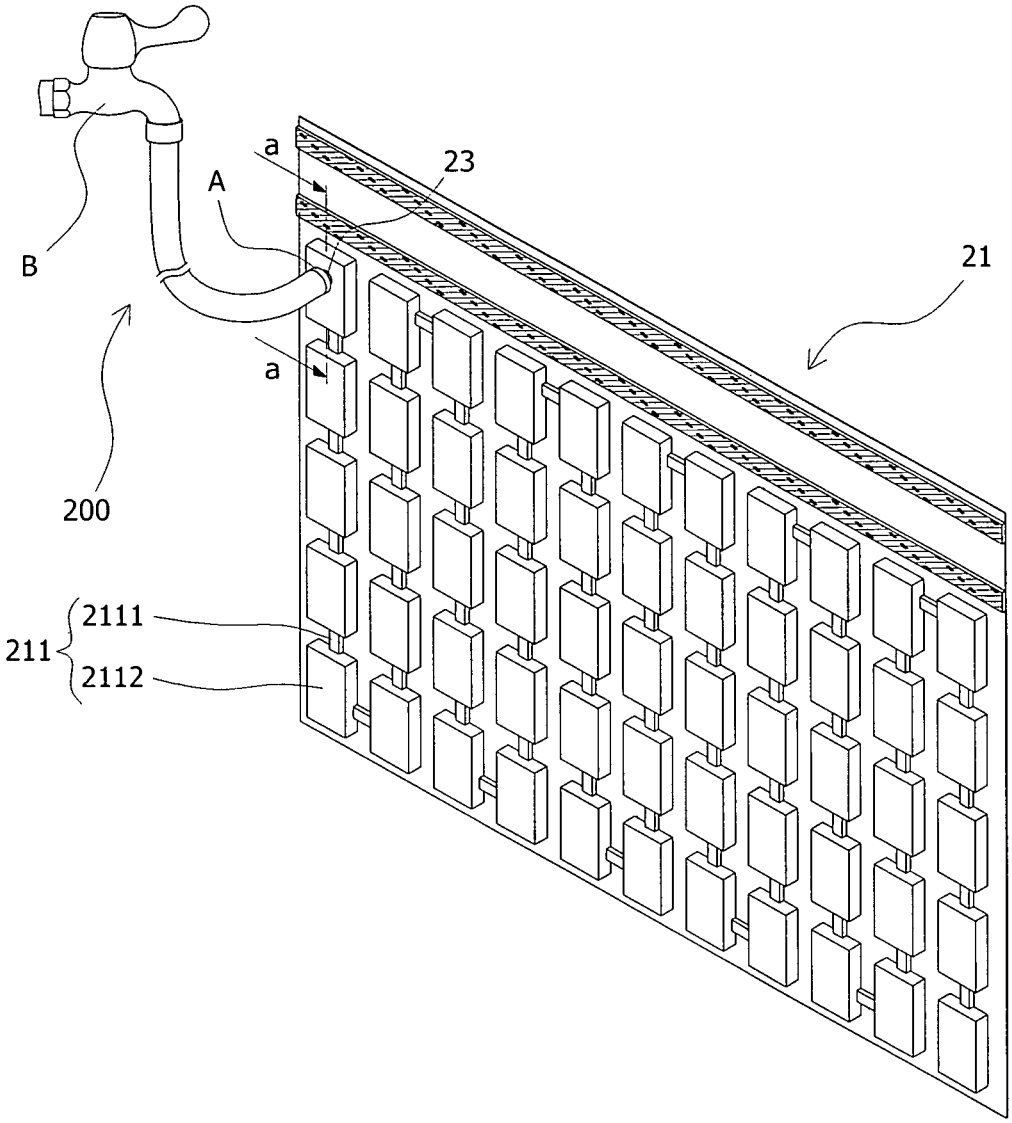
FIG. 10: Implementation view of the present invention when inputting water into the sheet-shaped bag.
Figure 11:
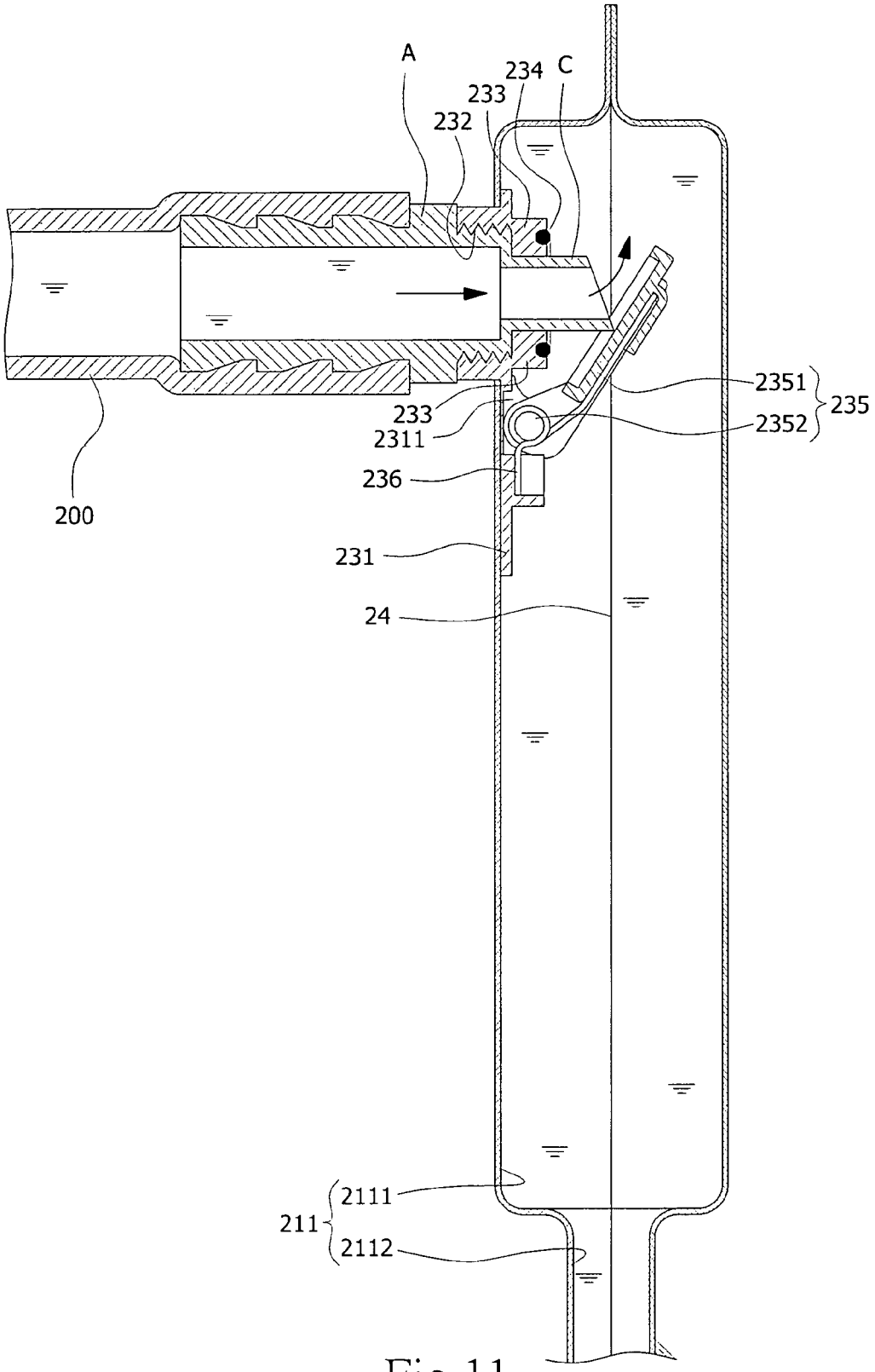
FIG. 11: A—a sectional view of FIG. 10.
Figure 12:
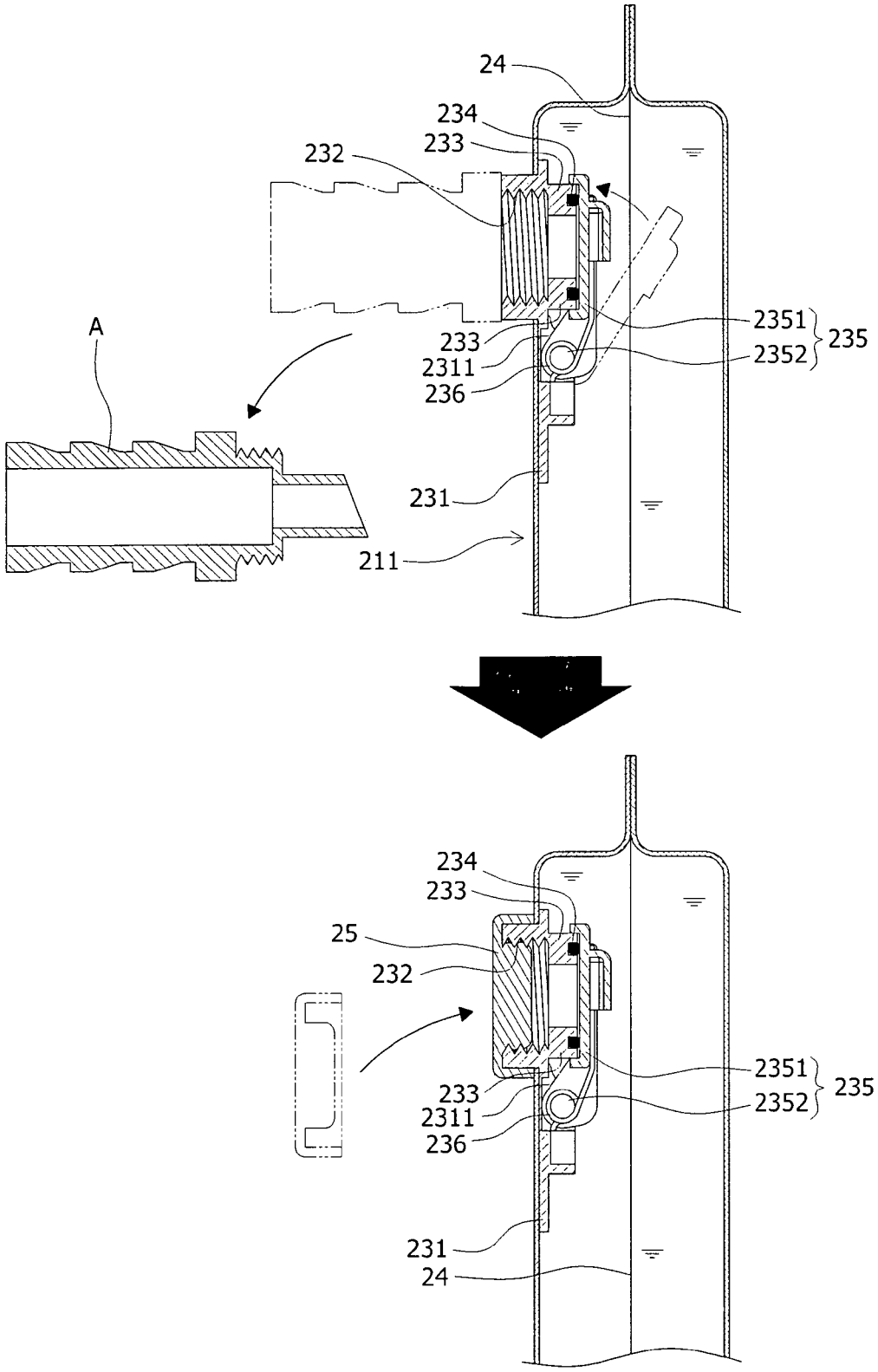
FIG. 12: Sectional view of FIG. 11 when inputting water and when water input is completed.

Referring to FIGS. 8, 10, and 11, said liquid injection device (200) includes a hollow connecting head (A) disposed with external threads on its outer wall for threaded joint with the water inlet (232); a liquid connecting head (B) arranged at one end of the connecting head (A), and communicated with the connecting head (A) to connect with the liquid pipeline (300); and a top tube portion (C) arranged at another end of the connecting head (A), communicated with the connecting head (A) to push against the valve cover gasket (2351) and to control opening of the valve cover gasket (2351).

In particular, said liquid injection device (200) disposed with the connecting head (A) and the water inlet (232) to prevent liquid from leaking out from the connecting point, and fill liquid continuously into the sheet-shaped bag (21) via the liquid pipeline (300). The top tube portion (C) can effectively push the valve cover gasket (2351) to open when the connecting head (A) is screwed in, allowing the water inlet (232) to communicate with the sheet-shaped bag (21), and the liquid to be filled into the sheet-shaped bag (21). Reversely, when the connecting head (A) is unscrewed, the elasticity of the torsion spring (236) plus the pressure from the liquid can instantly and automatically close the valve cover gasket (2351), stopping the water inlet (232) from communicating with the sheet-shaped bag (21), so that the liquid can not flow out from the sheet-shaped bag (21).

In the two preferred embodiments, said flow passages (211) comprise a plurality of evenly spaced liquid holding chambers (2111) for holding liquid, as disclosed in FIGS. 1 and 6, and liquid pathways (2112) to communicate with the liquid holding chambers (2111). The liquid inside one liquid holding chamber (2111) can flow to other liquid holding chambers (2111) through the liquid pathway (2112).

In particular, the liquid holding chambers (2111) and liquid pathways (2112) allow the liquid inside liquid holding chambers (2111) to conduct convection through the liquid pathways (2112), meaning there is convection between the hot area and cold area to effectively lower or maintain the outside temperatures. Meanwhile, the liquid holding chambers (2111) can enhance the insulation effect of the sheet-shaped bag (21).

Secondly, the liquid holding chambers (2111) and the liquid pathways (2112) can reduce the backflow of the liquid, thereby minimizing the possibility of leakage from the one-way valve (23).

In the two preferred embodiments, the storage container (100) disposed with inward sequential polyethylene foamed cotton layer (3) on the inner wall, and an aluminum foil reflective thermo-insulation layer (4) covered the surface of the polyethylene foamed cotton layer (3), as shown in FIG. 2.

In particular, the polyethylene foamed cotton layer (3) can reduce the heat exchange with the outside environment, and the aluminum foil reflective thermo-insulation layer (4) can reflect the heat radiation, thereby reducing the heat loss caused by heat radiation. Said two layers for achieving insulation effect are made of soft and light materials, and are easy to install. The materials are tasteless and non-toxic, environmentally safe, and are safe and comfortable to the users.

Secondly, the storage container (100) is soft like a backpack, and its outer casing, i.e., the outer side of the polyethylene foamed cotton layer (3), is made of Nylon.

In the two preferred embodiments, to meet different needs, the storage container (100) can appear in various forms, such as a shoulder-carry bag, a backpack bag, or even a case. Both soft and hard casing of the storage container (100) can be practical for the users. Moreover, said one-way valve (23) connected to any one of the liquid holding chambers (2111).

In particular, the one-way valve (23) disposed at a liquid holding chamber (2111), and the liquid can flow between liquid holding chambers (2111). Secondly, the one-way valve (23) can be arranged at any liquid holding chambers (2111) as needed.

In the two preferred embodiments, the insulation device (2) comprises a plurality of sheet-shaped bags (21*a*~21*e*), and the sheet-shaped bags (21) can be separated from each other (as shown in FIGS. 1 and 6), or be a one-piece body (not shown in the drawing). In the case of one-piece body, the sheet-shaped bags (21) can be integrally formed and communicated by the plastic film itself.

There is no limitation on the actual shape of the sheet-shaped bag (21), as long as it can fit the inner surface (20) of the storage container (100), such as rectangular, round, oval, or spiral shapes.

Although the invention has been explained in relation to its preferred embodiment, it is to be understood that many other possible modifications and variations can be made without departing from the spirit and scope of the invention as hereinafter claimed.

I claim:

1. A storage container with insulation effect, said container (100) having a storage space (10):

the storage space (10) includes a supporting frame (1) with a positioning space (20) formed therein and a insulation device (2) provided inside the positioning space (20);

said supporting frame (1) comprising a plurality of longitudinal poles (11), transverse poles (12), vertical poles (13) and branch joints (14) for forming the positioning space (20), the transverse poles (12) perpendicularly arranged between one ends of both the longitudinal poles (11), the vertical poles (13) arranged perpendicularly to the longitudinal poles (11) and the transverse poles (12), the branch joints (14) disposed at each corner of the supporting frame (1) and respectively connected with the longitudinal poles (11), the transverse poles (12), and the vertical poles (13);

said insulation device (2) comprising at least one sheet-shaped bag (21) and a positioning unit (22) arranged on the sheet-shaped bag (21), the sheet-shaped bag (21) configured to hold liquid, the positioning unit (22) configured to fix the sheet-shaped bag (21) on a corresponding side face (201) of the positioning space (20) to avoid movement; the sheet-shaped bag (21) having a flow passage (211) disposed therein for holding the liquid, and the flow passage (211) having a one-way valve (23) arranged at one end thereof, which can be used with an injection device (200) for control of a liquid input;

said positioning unit (22) comprising a plurality of waterproof bags (5) to hold the sheet-shaped bag (21), and fix the sheet-shaped bag (21) on a corresponding side face (201) of the positioning space (20) to avoid movement and to provide a waterproof function, the waterproof bags (5) having an opening (51) disposed in one side end thereof, and the opening having a covering plate (52) and a fastener (D) arranged between one side of the opening (51) and a corresponding side of the covering plate (52), the fastener (D) wrapping the longitudinal pole (11) and/or the transverse pole (12) to hang and fix the sheet-shaped bag (21);

wherein the one-way valve (23) comprises a positioning plate (231) arranged inside one end of the flow passage (211);

a water inlet (232) arranged inside the positioning plate (231) and having internal threads disposed on an inner wall thereof;

a convex ring portion (233) arranged at a bottom surface of the positioning plate (231), corresponding to the water inlet (232), and communicated with the water inlet (232);

an anti-leakage ring (234) arranged at a bottom end of the convex ring portion (233);

a valve plate (235) pivotally arranged on the bottom surface of the positioning plate (231) for sealing the convex ring portion (233) to control water inlet; and at least one torsion spring (236) arranged at a pivot of the valve plate (235) to force the valve plate (235) to tightly seal the convex ring portion (233);

wherein the valve plate (235) includes a valve cover gasket (2351) disposed in one side thereof for sealing the convex ring, portion (233), and a pivot portion (2352) disposed in other side thereof and configured for holding the torsion spring (236), moreover, the positioning plate (231) including a pivot positioning seat (2311) corresponding to the pivot portion (2352) for pivot connection;

wherein the one-way valve (23) further includes a rubber cap (25) to seal the water inlet (232).

2. The device defined in claim 1, wherein the fastener comprises a hook unit (D1) and a loop unit (D2).

3. The device defined in claim 1, wherein the longitudinal pole (11) and transverse pole (12) further include a spring (15) arranged inside a connection part whereat the branch joints (14) is disposed, said spring (15) configured to have an outward push force.

4. The device defined in claim 1, wherein the longitudinal pole (11) further includes a central supporting component (16) arranged therebetween to connect simultaneously with both sides of the longitudinal poles (11) when there is more than one longitudinal pole (11), the central supporting component (16) including a top T-shape branch joint (161) disposed between and connected the longitudinal poles (11) on two top sides, a bottom T-shape branch joint (162) disposed between and connected the longitudinal poles (11) on two bottom sides, and a central vertical pole (163) vertically disposed between the top T-shape branch joint (161) and the bottom T-shape branch joint (162);

a connection part between said to T-shape branch joint 161) and said bottom T-shape branch joint (162) further provided with a spring (15) generating an outward push force at the positions connecting with the longitudinal poles (11).

5. The device defined in claim 1, wherein the sheet-shaped bag (21) is made by laminating two Nylon and LLDPE plastic films with toughness and resistance to high and low temperatures, the sheet-shaped bag (21) further including a plurality of heat sealing lines (24) distributed at regular intervals, so as to form flow passages (211) inside for liquid flow.

6. The device defined in claim 1, wherein the opening (51) further includes a sealing bar (511) and a sealing slot (512) arranged in an open ended thereof, the sealing bar (511) being arranged correspondingly to the sealing slot (512).

* * * * *